US011401688B2

(12) United States Patent
Okuwaki et al.

(10) Patent No.: US 11,401,688 B2
(45) Date of Patent: Aug. 2, 2022

(54) LOADING MACHINE CONTROL DEVICE AND CONTROL METHOD

(71) Applicant: KOMATSU LTD., Tokyo (JP)

(72) Inventors: Ryuta Okuwaki, Tokyo (JP); Yusuke Saigo, Tokyo (JP)

(73) Assignee: KOMATSU LTD., Tokyo (JP)

( * ) Notice: Subject to any disclaimer, the term of this patent is extended or adjusted under 35 U.S.C. 154(b) by 10 days.

(21) Appl. No.: 17/045,812

(22) PCT Filed: Mar. 12, 2019

(86) PCT No.: PCT/JP2019/010107
§ 371 (c)(1),
(2) Date: Oct. 7, 2020

(87) PCT Pub. No.: WO2019/207993
PCT Pub. Date: Oct. 31, 2019

(65) Prior Publication Data

US 2021/0102357 A1 Apr. 8, 2021

(30) Foreign Application Priority Data

Apr. 27, 2018 (JP) ..... JP2018-087762

(51) Int. Cl.
*E02F 9/12* (2006.01)
*E02F 9/22* (2006.01)

(52) U.S. Cl.
CPC ..... *E02F 9/123* (2013.01); *E02F 9/128* (2013.01); *E02F 9/2221* (2013.01)

(58) Field of Classification Search
CPC ..... E02F 9/123; E02F 9/128
See application file for complete search history.

(56) References Cited

U.S. PATENT DOCUMENTS 4,680,929 A * 7/1987 Mouri ..... E02F 3/325 60/368
10,450,722 B2 * 10/2019 Moriki ..... E02F 9/2033
(Continued)

FOREIGN PATENT DOCUMENTS

GB 2 134 876 A 8/1984
JP 59-85043 A 5/1984
(Continued)

OTHER PUBLICATIONS

The International Search Report for the corresponding international application No. PCT/JP2019/010107, dated May 7, 2019.

*Primary Examiner* — F Daniel Lopez
*Assistant Examiner* — Michael Quandt
(74) *Attorney, Agent, or Firm* — Global IP Counselors, LLP

(57) ABSTRACT

A control device of a loading machine includes an adjustment determination unit and an operation signal output unit. The loading machine includes a swing motor and a swing body. The adjustment determination unit determines whether or not an angle formed by an azimuth direction of a swing body when the swing body stops and a target stop azimuth direction is less than an allowable angle based on an azimuth direction, a swing speed, and the target stop azimuth direction of the swing body during braking of the swing motor. The operation signal output unit outputs a swing control signal for driving the swing motor in a case in which it is determined that the angle formed by the azimuth direction of the swing body when the swing body stops and the target stop azimuth direction is equal to or greater than the allowable angle.

6 Claims, 9 Drawing Sheets

(56) References Cited

U.S. PATENT DOCUMENTS

| | | | | |
|---|---|---|---|---|
| 2010/0264106 | A1 | 10/2010 | Kawai et al. | |
| 2013/0116897 | A1 | 5/2013 | Lee et al. | |
| 2014/0257647 | A1 | 9/2014 | Wu et al. | |
| 2021/0180291 | A1* | 6/2021 | Saiki | B66C 13/40 |

FOREIGN PATENT DOCUMENTS

| | | | |
|---|---|---|---|
| JP | 61-45031 | A | 3/1986 |
| JP | 62-13620 | A | 1/1987 |
| JP | 62-258025 | A | 11/1987 |
| JP | 2807728 | B2 | 7/1998 |

* cited by examiner

LOADING MACHINE CONTROL DEVICE AND CONTROL METHOD

CROSS-REFERENCE TO RELATED APPLICATIONS

This application is a U.S. National stage application of International Application No. PCT/JP2019/010107, filed on Mar. 12, 2019. This U.S. National stage application claims priority under 35 U.S.C. § 119(a) to Japanese Patent Application No. 2018-087762, filed in Japan on Apr. 27, 2018, the entire contents of which are hereby incorporated herein by reference.

BACKGROUND

Field of the Invention

The present invention relates to a loading machine control device and a control method.

Background Information

Japanese Unexamined Patent Application, First Publication No. 62-258025 discloses a technique for suppressing overshoot with respect to a set stop position in automatic stop control of swinging of a loading machine. According to Japanese Unexamined Patent Application, First Publication No. 62-258025, a loading machine control device determines a target swing speed based on a deviation between the set stop position and the current position, increases the swing speed in a case where the swing speed is lower than the target swing speed, and performs feedback control so as to reduce the swing speed in a case where the swing speed is higher than the target swing speed. Here, in order to suppress overshoot, an integral term of a feedback amount is increased when the swing speed is lower than a set value, and is decreased when the swing speed is equal to or higher than the set value.

SUMMARY

In the invention described in Japanese Unexamined Patent Application, First Publication No. 62-258025, feedback control is always performed such that the swing speed of a swing body is close to the target swing speed. However, a hydraulic motor that swings the swing body cannot exert a braking force that exceeds a relief pressure of a relief valve provided in a hydraulic circuit. Therefore, in a case where the swing speed is higher than the target swing speed, the feedback control acts to reduce the swing speed. However, in a case of braking the swing body in a state where an internal pressure of the hydraulic circuit reaches the relief pressure, the swing speed cannot be close to the target swing speed. In this case, the feedback control of the swing speed increases the integral term of the feedback control regardless of the degree of the swing speed, and after the swing body stops beyond a set stop position, the swing speed is reversed by the feedback control and tries to return to the set stop position, but there is a possibility that the integral term becomes extremely large and the swing body exceeds the set stop position again.

An objective of the present invention provides a loading machine control device and a control method for controlling an azimuth direction in which a swing body faces by performing swing control as necessary.

According to a first aspect of the present invention, there is provided a control device of a loading machine including a swing motor, and a swing body that swings around a swing center by rotation of the swing motor, the device including: an adjustment determination unit that determines whether or not an angle formed by an azimuth direction of the swing body when the swing body stops and a target stop azimuth direction is less than an allowable angle based on the azimuth direction, a swing speed, and the target stop azimuth direction of the swing body during braking of the swing motor; and an operation signal output unit that outputs a swing control signal for driving the swing motor in a case where it is determined that the angle formed by the azimuth direction of the swing body when the swing body stops and the target stop azimuth direction is equal to or greater than the allowable angle.

According to at least one of the above-described aspects, the control device can control the azimuth direction in which the swing body faces by performing swing control as necessary.

DETAILED DESCRIPTION OF EMBODIMENT(S)

Hereinafter, embodiments will be described with reference to the drawings.

First Embodiment

<<Configuration of Loading Machine>>

Figure 1:
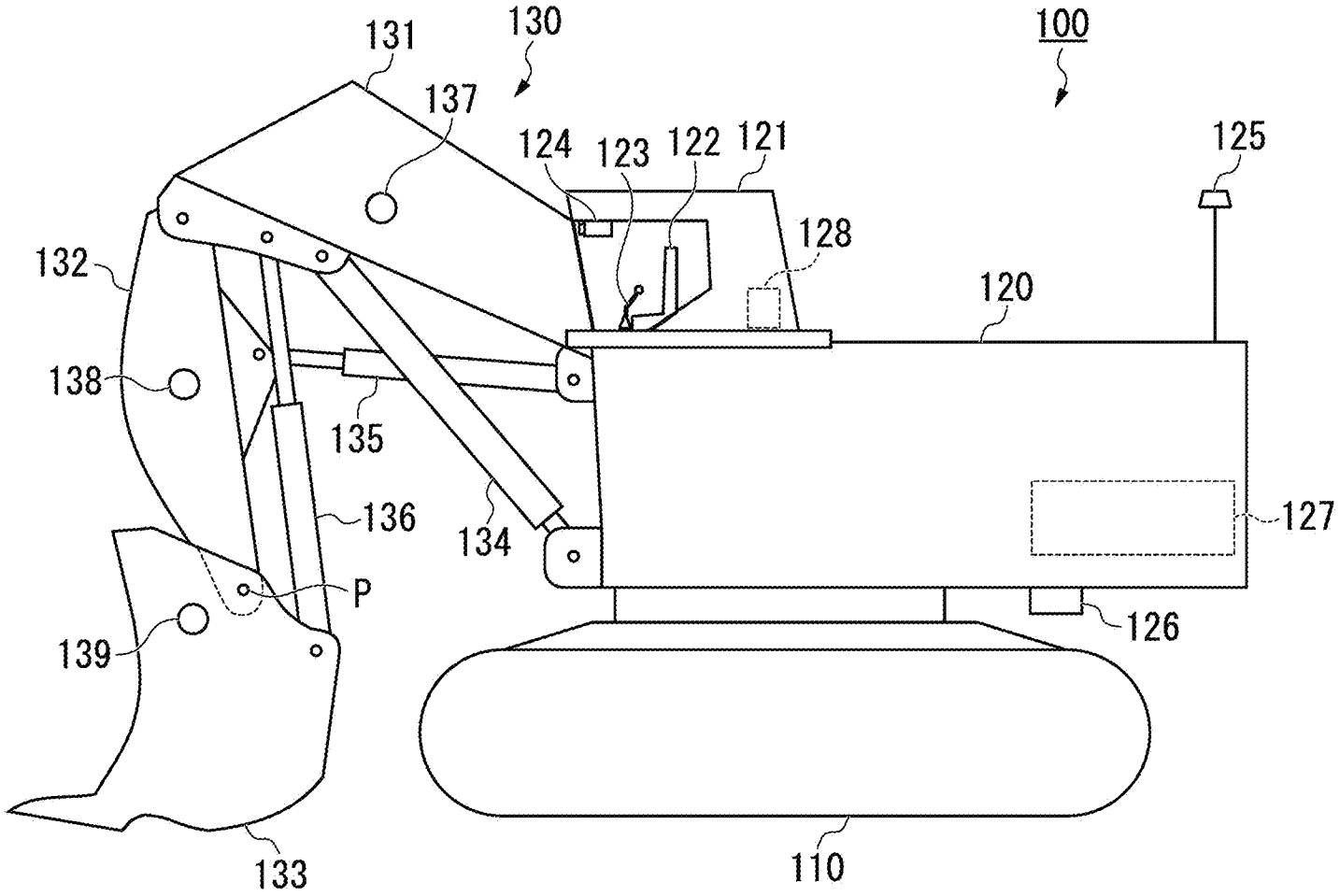
FIG. 1 is a schematic view showing a configuration of a loading machine according to a first embodiment.

FIG. 1 is a schematic view showing a configuration of a loading machine according to a first embodiment.

Figure 2:
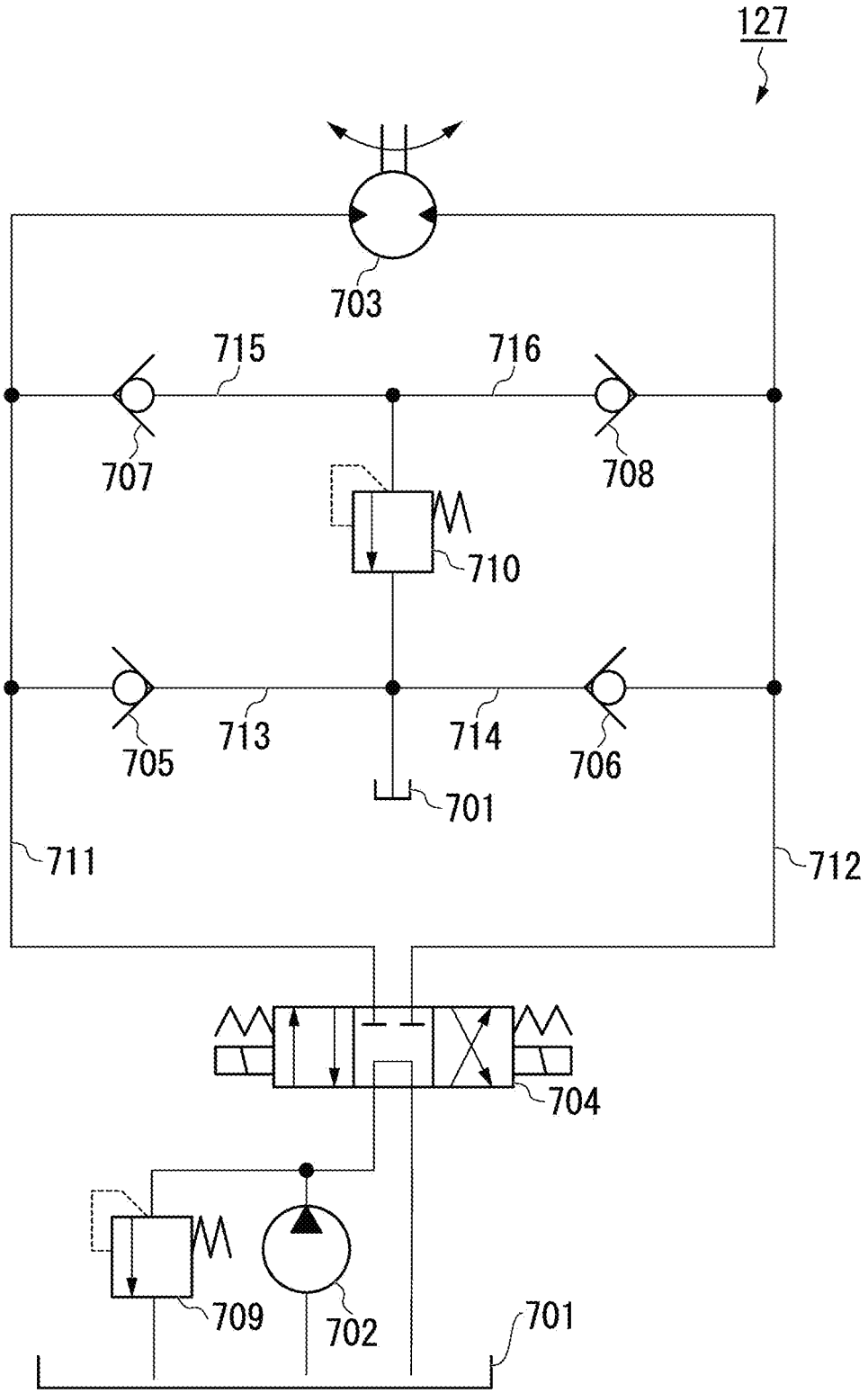
FIG. 2 is a schematic hydraulic circuit view showing a configuration that contributes to swinging of a swing body in a hydraulic device according to the first embodiment.

A loading machine 100 is a work machine for loading earth onto a loading target 200, such as a transport vehicle. The loading machine 100 according to the first embodiment is a hydraulic excavator. In addition, the loading machine 100 according to another embodiment may be a loading machine 100 other than a hydraulic excavator. In addition, although the loading machine 100 shown in FIG. 2 is a face shovel, but may be a backhoe shovel, or a rope shovel. Examples of the loading target 200 include a transport vehicle and a hopper.

The loading machine 100 includes a travel body 110, a swing body 120 supported by the travel body 110, and work equipment 130 operated by hydraulic pressure and supported by the swing body 120. The swing body 120 is supported by the travel body 110 so as to be capable of swinging around a swing center.

The work equipment 130 includes a boom 131, an arm 132, a bucket 133, a boom cylinder 134, an arm cylinder 135, a bucket cylinder 136, a boom angle sensor 137, an arm angle sensor 138, and a bucket angle sensor 139.

A base end portion of the boom 131 is attached to the swing body 120 via a pin.

The arm 132 connects the boom 131 and the bucket 133 to each other. A base end portion of the arm 132 is attached to a tip end portion of the boom 131 via a pin.

The bucket 133 includes a blade for excavating earth, and a container for accommodating the excavated earth. A base end portion of the bucket 133 is attached to the tip end portion of the arm 132 via a pin.

The boom cylinder 134 is a hydraulic cylinder for operating the boom 131. A base end portion of the boom cylinder 134 is attached to the swing body 120. A tip end portion of the boom cylinder 134 is attached to the boom 131.

The arm cylinder 135 is a hydraulic cylinder for driving the arm 132. A base end portion of the arm cylinder 135 is attached to the boom 131. A tip end portion of the arm cylinder 135 is attached to the arm 132.

The bucket cylinder 136 is a hydraulic cylinder for driving the bucket 133. A base end portion of the bucket cylinder 136 is attached to the boom 131. A tip end portion of the bucket cylinder 136 is attached to the bucket 133.

The boom angle sensor 137 is attached to the boom 131 and detects an inclination angle of the boom 131.

The arm angle sensor 138 is attached to the arm 132 and detects an inclination angle of the arm 132.

The bucket angle sensor 139 is attached to the bucket 133 and detects an inclination angle of the bucket 133.

The boom angle sensor 137, the arm angle sensor 138, and the bucket angle sensor 139 according to the first embodiment detect the inclination angle with respect to a ground plane. In addition, the angle sensor according to another embodiment is not limited thereto, and may detect the inclination angle with respect to another reference plane. For example, in another embodiment, the angle sensor may detect a relative rotation angle with a potentiometer provided at the base end portions of the boom 131, the arm 132, and the bucket 133, or may detect the inclination angle by measuring the cylinder lengths of the boom cylinder 134, the arm cylinder 135, and the bucket cylinder 136, and by converting the cylinder length into an angle.

The swing body 120 is provided with an operation room 121. Inside the operation room 121, a driver seat 122 for an operator to sit on, an operating device 123 for operating the loading machine 100, and a detecting device 124 for detecting a three-dimensional position of an object that exists in a detection direction, are provided. In response to an operation of the operator, the operating device 123 generates an operation signal of the boom cylinder 134, an operation signal of the arm cylinder 135, an operation signal of the bucket cylinder 136, a swing operation signal to the left and right of the swing body 120, and a traveling operation signal for forward and backward traveling of the travel body 110 and outputs the operation signals to a control device 128. In addition, the operating device 123 generates a loading command signal for causing the work equipment 130 to start automatic loading control in accordance with the operation of the operator and outputs the loading command signal to the control device 128. The loading command signal is an example of a command to start automatic movement of the bucket 133. The operating device 123 is configured with, for example, a lever, a switch, and a pedal. The loading instruction signal is operated by operating a switch. For example, when the switch is pressed, a loading command signal is output. The operating device 123 is disposed in the vicinity of the driver seat 122. The operating device 123 is positioned within a range that can be operated by the operator when the operator sits on the driver seat 122.

Examples of the detecting device 124 include a stereo camera, a laser scanner, and an ultra wide band (UWB) distance measuring device. The detecting device 124 is provided such that the detection direction faces the front of the operation room 121 of the loading machine 100, for example. The detecting device 124 specifies the three-dimensional position of the object in a coordinate system with the position of the detecting device 124 as a reference.

In addition, the loading machine 100 according to the first embodiment is operated according to the operation of the operator who sits on the driver seat 122, but is not limited thereto in another embodiment. For example, the loading machine 100 according to another embodiment may be operated by a remote operation.

The loading machine 100 includes a position and azimuth direction calculator 125, an inclination measuring device 126, a hydraulic device 127, and the control device 128.

The position and azimuth direction calculator 125 calculates a position of the swing body 120 and an azimuth direction in which the swing body 120 faces. The position and azimuth direction calculator 125 includes two receivers that receive positioning signals from artificial satellites that configure a GNSS. The two receivers are respectively installed at different positions on the swing body 120. Based on the positioning signal received by the receiver, the position and azimuth direction calculator 125 detects the position of the representative point (the origin of the shovel coordinate system) of the swing body 120 in a site coordinate system.

The position and azimuth direction calculator 125 calculates the azimuth direction in which the swing body 120 faces as a relationship between an installation position of one receiver and an installation position of the other receiver by using each positioning signal received by the two receivers.

The inclination measuring device 126 measures an acceleration and an angular velocity (swing speed) of the swing body 120 and detects the posture (for example, roll angle, pitch angle, yaw angle) of the swing body 120 according to the measurement result. The inclination measuring device 126 is installed on a lower surface of the swing body 120, for example. For example, an inertial measurement unit (IMU) can be used as the inclination measuring device 126.

The hydraulic device 127 supplies hydraulic oil to the swing body 120, the travel body 110, the boom cylinder 134, the arm cylinder 135, and the bucket cylinder 136. The amount of the hydraulic oil, which is supplied from the hydraulic device 127 to the swing body 120, the travel body 110, the boom cylinder 134, the arm cylinder 135, and the bucket cylinder 136, is controlled by the control device 128.

The control device 128 receives the operation signal from the operating device 123. The control device 128 drives the work equipment 130, the swing body 120, or the travel body 110 by outputting the operation signal to the hydraulic device 127.

<<Configuration of Hydraulic Device>>

FIG. 2 is a schematic hydraulic circuit view showing a configuration that contributes to swinging of the swing body 120 in a hydraulic device 127 according to the first embodiment.

The hydraulic device 127 includes a hydraulic oil tank 701, a hydraulic pump 702, a swing motor 703, a direction control valve 704, a first check valve 705, a second check valve 706, a third check valve 707, a fourth check valve 708, a first relief valve 709, and a second relief valve 710.

The hydraulic oil tank 701 stores hydraulic oil.

The hydraulic pump 702 is driven by a prime mover (not shown) of the loading machine 100 and transfers the hydraulic oil stored in the hydraulic oil tank 701.

The swing motor 703 is driven by the hydraulic oil supplied via a first main pipe line 711 or a second main pipe line 712, and causes the swing body 120 to swing around a swing center.

The direction control valve 704 is provided between the hydraulic pump 702 and the swing motor 703. The direction control valve 704 and the swing motor 703 are connected to each other by the first main pipe line 711 and the second main pipe line 712. The direction control valve 704 switches a flow direction of the hydraulic oil supplied from the hydraulic pump 702. The direction control valve 704 is a 4-port 3-position solenoid valve. The direction control valve 704 switches the flow direction by driving the left and right solenoids according to the operation signal input from the control device 128 and displacing an internal spool. In a case where the spool of the direction control valve 704 is at a neutral position, the hydraulic oil is discharged to the hydraulic oil tank 701 without being supplied to the swing motor 703. When the left solenoid of the direction control valve 704 is excited by the operation signal, the hydraulic oil is supplied to the swing motor 703 via the first main pipe line 711 and discharged to the hydraulic oil tank 701 via the second main pipe line 712. Accordingly, the swing motor 703 rotates rightward. On the other hand, when the right solenoid of the direction control valve 704 is excited by the operation signal, the hydraulic oil is supplied to the swing motor 703 via the second main pipe line 712 and discharged to the hydraulic oil tank 701 via the first main pipe line 711. Accordingly, the swing motor 703 rotates leftward. Further, the opening area of the direction control valve 704 varies depending on the spool position of the direction control valve 704. Therefore, the direction control valve 704 can adjust the flow rate of the hydraulic oil according to a magnitude of the operation signal. In other words, the direction control valve 704 is a main valve that controls the flow rate of the hydraulic oil supplied to the swing motor 703.

The first check valve 705 is provided in a first branch pipe line 713 that branches from the first main pipe line 711 and is connected to the hydraulic oil tank 701. The first check valve 705 does not prevent the hydraulic oil from flowing from the hydraulic oil tank 701 to the first main pipe line 711. Accordingly, the first check valve 705 can prevent the first main pipe line 711 from being in a negative pressure state.

The second check valve 706 is provided in a second branch pipe line 714 that branches from the second main pipe line 712 and is connected to the hydraulic oil tank 701. The second check valve 706 does not prevent the hydraulic oil from flowing from the hydraulic oil tank 701 to the second main pipe line 712. Accordingly, the second check valve 706 can prevent the second main pipe line 712 from being in a negative pressure state.

The third check valve 707 is provided in a third branch pipe line 715 that branches from the first main pipe line 711 and is connected to the hydraulic oil tank 701 via the second relief valve 710. The third check valve 707 does not prevent the hydraulic oil from flowing from the first main pipe line 711 to the second relief valve 710.

The fourth check valve 708 is provided in a fourth branch pipe line 716 that branches from the second main pipe line 712 and is connected to the hydraulic oil tank 701 via the second relief valve 710. The fourth check valve 708 does not prevent the hydraulic oil from flowing from the second main pipe line 712 to the second relief valve 710.

The first relief valve 709 is provided between a discharge port of the hydraulic pump 702 and the hydraulic oil tank 701 and discharges the hydraulic oil to the hydraulic oil tank 701 when the pressure applied to the first relief valve 709 becomes equal to or higher than a set relief pressure. Accordingly, the first relief valve 709 can prevent the pressure of the hydraulic oil discharged from the hydraulic pump 702 from becoming extremely high.

The second relief valve 710 is provided between the third branch pipe line 715 and the fourth branch pipe line 716 and the hydraulic oil tank 701 and discharges the hydraulic oil to the hydraulic oil tank 701 when the pressure applied to the second relief valve 710 becomes equal to or higher than the set relief pressure. Accordingly, the second relief valve 710 can prevent an internal pressure of the first main pipe line 711 or the second main pipe line 712 from becoming extremely high. By providing the second relief valve 710, a maximum value of the braking force of the swing motor 703 corresponds to the relief pressure of the second relief valve 710.

<<Configuration of Control Device>>

The control device 128 receives the operation signal from the operating device 123. The control device 128 operates the work equipment 130, the swing body 120, or the travel body 110 by outputting the operation signal to the hydraulic device 127.

Figure 3:
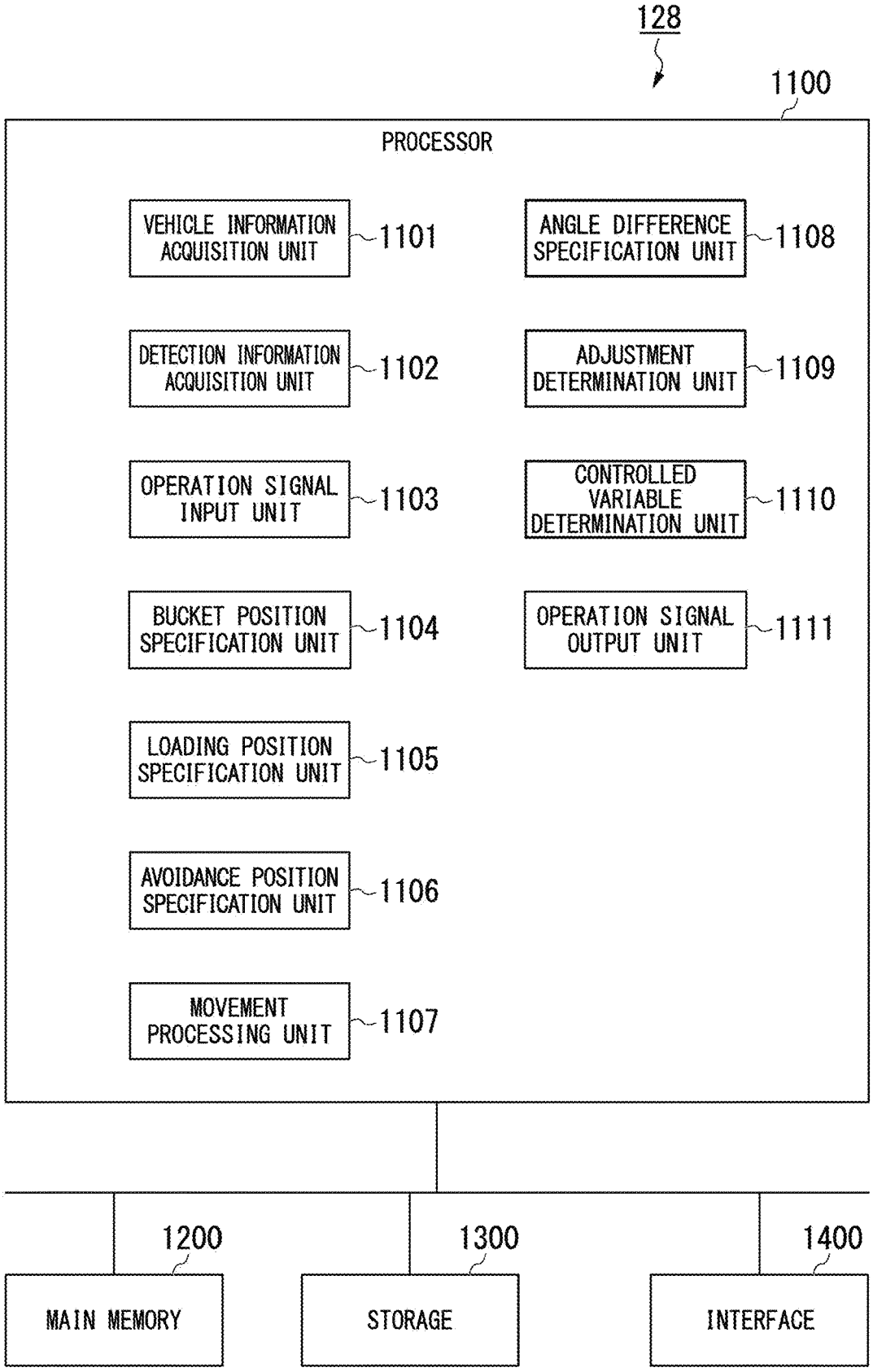
FIG. 3 is a schematic block diagram showing a configuration of a control device according to the first embodiment.

FIG. 3 is a schematic block diagram showing a configuration of the control device according to the first embodiment.

The control device 128 is a computer including a processor 1100, a main memory 1200, a storage 1300, and an interface 1400. The storage 1300 stores a program. The processor 1100 reads the program from the storage 1300, loads the program in the main memory 1200, and executes processing based on the program.

Examples of the storage 1300 include HDDs, SSDs, magnetic disks, magneto-optical disks, CD-ROMs, DVD-ROMs, and the like. The storage 1300 may be an internal medium directly connected to a common communication line of the control device 128, or may be an external medium connected to the control device 128 via the interface 1400. The storage 1300 is a non-transitory type storage medium.

The processor 1100 is executed by a program and includes a vehicle information acquisition unit 1101, a detection information acquisition unit 1102, an operation signal input unit 1103, a bucket position specification unit 1104, a loading position specification unit 1105, an avoidance position specification unit 1106, a movement processing unit 1107, an angle difference specification unit 1108, an adjustment determination unit 1109, a controlled variable determination unit 1110, and an operation signal output unit 1111.

The vehicle information acquisition unit 1101 acquires the swing speed, the position and the azimuth direction of the swing body 120, the inclination angles of the boom 131, the arm 132, and the bucket 133, the traveling speed of the travel body 110, and the posture of the swing body 120. Hereinafter, information on the loading machine 100 acquired by the vehicle information acquisition unit 1101 will be referred to as vehicle information.

The detection information acquisition unit 1102 acquires three-dimensional position information from the detecting device 124 and specifies a position and a shape of the loading target 200 (for example, a transport vehicle or a hopper).

The operation signal input unit 1103 receives an operation signal input from the operating device 123. An operation signal of the boom 131, an operation signal of the arm 132, an operation signal of the bucket 133, a swing operation signal of the swing body 120, a traveling operation signal of the travel body 110, and a loading command signal of the loading machine 100 are included.

Figure 4:
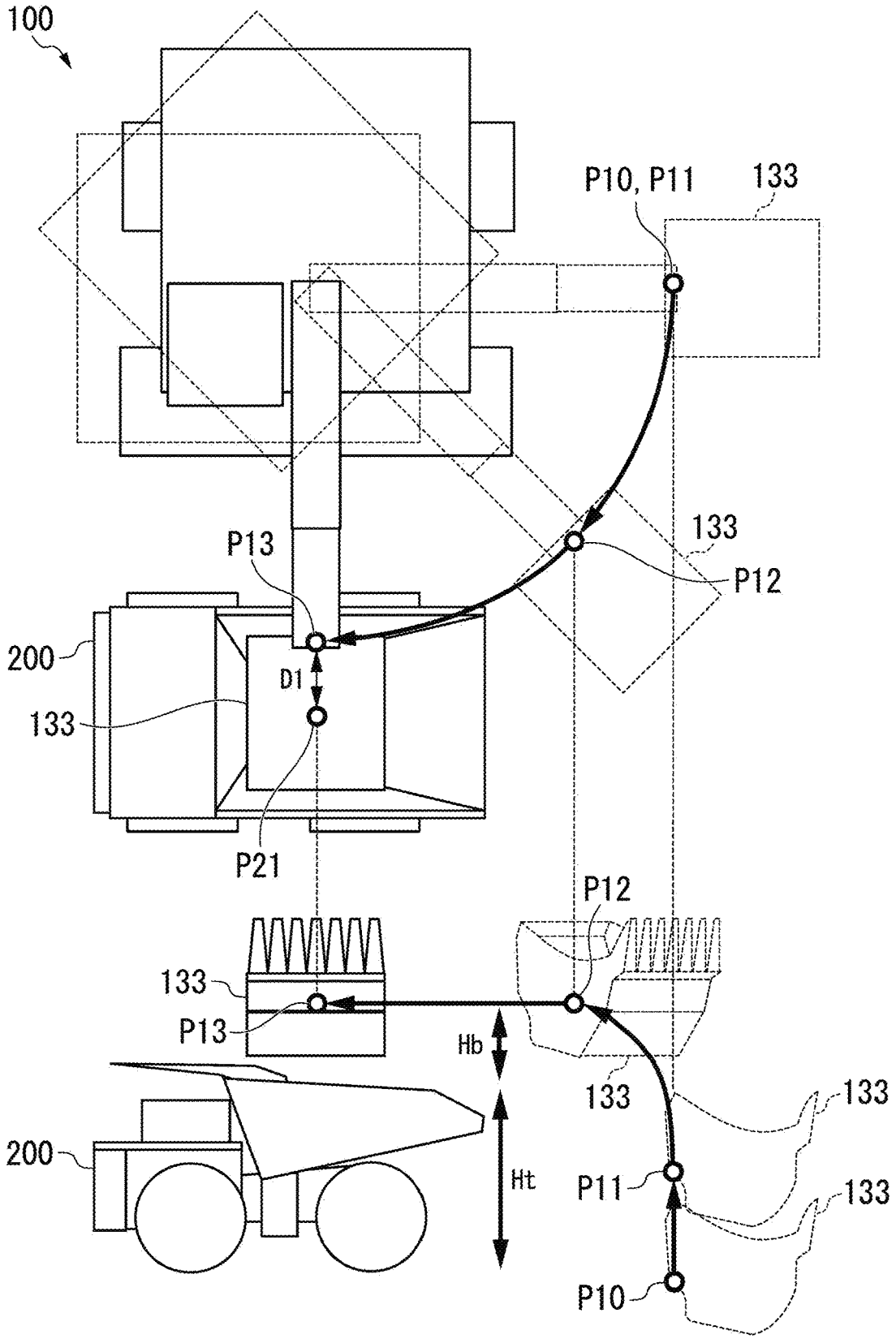
FIG. 4 is a view showing an example of a bucket path according to the first embodiment.

Based on the vehicle information acquired by the vehicle information acquisition unit 1101, the bucket position specification unit 1104 specifies a position P of the tip end of the arm 132 in the shovel coordinate system and a height Hb from the tip end of the arm 132 to the lowest point of the bucket 133. The lowest point of the bucket 133 means a point having the shortest distance from a ground surface in the outer shape of the bucket 133. In particular, the bucket position specification unit 1104 specifies the position P of the tip end of the arm 132 as an excavation completion position P10 when the input of the loading command signal is received. FIG. 4 is a view showing an example of a bucket path according to the first embodiment. Specifically, the bucket position specification unit 1104 obtains vertical direction components and horizontal direction components of the length of the boom 131 based on the inclination angle of the boom 131 and the known length (the distance from the pin of the base end portion to the pin at the tip end portion) of the boom 131. Similarly, the bucket position specification unit 1104 obtains the vertical direction components and the horizontal direction components of the length of the arm 132. The bucket position specification unit 1104 specifies a position separated from the position of the loading machine 100 by the sum of the vertical direction components and the sum of horizontal direction components of the lengths of the boom 131 and the arm 132, in the direction specified from the azimuth direction and posture of the loading machine 100, as the position P (position P of the pin of the tip end portion of the arm 132 shown in FIG. 1) of the tip end of the arm 132. Further, the bucket position specification unit 1104 specifies the lowest point in the vertical direction of the bucket 133 based on the inclination angle of the bucket 133 and the known shape of the bucket 133 and specifies the height Hb from the tip end of the arm 132 to the lowest point.

The loading position specification unit 1105 specifies a loading position P13 based on the position and the shape of the loading target 200 specified by the detection information acquisition unit 1102 in a case where the loading command signal is input to the operation signal input unit 1103. The loading position specification unit 1105 converts a loading point P21 indicated by the position information of the loading target 200 from the site coordinate system to the shovel coordinate system based on the position, the azimuth direction, and the posture of the swing body 120 acquired by the vehicle information acquisition unit 1101. The loading position specification unit 1105 specifies a position separated from the specified loading point P21 by a distance D1 from the center of the bucket 133 to the tip end of the arm 132 in the direction in which the swing body 120 of the loading machine 100 faces, as a plane position of the loading position P13. In other words, when the tip end of the arm 132 is positioned at the loading position P13, the center of the bucket 133 is positioned at the loading point P21. Therefore, the control device 128 can move the center of the bucket 133 to the loading point P21 by controlling the tip end of the arm 132 to move to the loading position P13. Hereinafter, the direction in which the swing body 120 faces when the tip end of the arm 132 is positioned at the loading position P13 is also referred to as a target stop azimuth direction. The loading position specification unit 1105 specifies a height of the loading position P13 by adding the height Hb from the tip end of the arm 132 specified by the bucket position specification unit 1104 to the lowest point and the height for the control margin of the bucket 133 to a height Ht of the loading target 200. In another embodiment, the loading position specification unit 1105 may specify the loading position P13 without adding the height for the control margin. In other words, the loading position specification unit 1105 may specify the height of the loading position P13 by adding the height Hb to the height Ht.

The avoidance position specification unit 1106 specifies an interference avoidance position P12 that is a point at which the work equipment 130 and the loading target 200 do not interfere with each other in a plan view from above based on the loading position P13 specified by the loading position specification unit 1105, the position of the loading machine 100 acquired by the vehicle information acquisition unit 1101, and the position and the shape of the loading target 200 specified by the detection information acquisition unit 1102. The interference avoidance position P12 has the same height as the loading position P13, the distance from the swing center of the swing body 120 is equal to the distance from the swing center to the loading position P13, and the interference avoidance position P12 is a position where the loading target 200 does not exist therebelow. The avoidance position specification unit 1106 specifies, for example, a circle of which the center is the swing center of the swing body 120 and of which the radius is the distance between the swing center and the loading position P13, and among the positions on the circle, specifies a position at which the outer shape of the bucket 133 does not interfere with the loading target 200 in a plan view from above and which is the closest to the loading position P13 as the interference avoidance position P12. The avoidance position specification unit 1106 can determine whether or not the loading target 200 and the bucket 133 interfere with each other based on the position and the shape of the loading target 200 and the known shape of the bucket 133. Here, "the same height" and "the distances are equal" are not necessarily limited to those in which the heights or distances completely match each other, and some errors and margins are allowed.

In a case where the operation signal input unit 1103 receives the input of the loading command signal, the movement processing unit 1107 generates the operation signal for moving the bucket 133 to the loading position P13 based on the loading position P13 specified by the loading position specification unit 1105 and the interference avoidance position P12 specified by the avoidance position specification unit 1106. In other words, the movement processing unit 1107 generates the operation signal so as to reach the loading position P13 from the excavation completion position P10 via a swing start position P11 and the interference avoidance position P12. Further, the movement processing unit 1107 generates the operation signal for the bucket 133 such that a ground angle of the bucket 133 does not change even when the boom 131 and the arm 132 are driven.

The angle difference specification unit 1108 specifies a swing angle difference that represents an angle formed by the azimuth direction in which the swing body 120 currently faces and the target stop azimuth direction. The swing angle difference has a negative value in a case where the azimuth direction in which the swing body 120 currently faces is behind the target stop azimuth direction in the swing direction. The swing angle difference has a positive value in a case where the azimuth direction in which the swing body 120 currently faces is ahead of the target stop azimuth direction in the swing direction.

The azimuth direction in which the swing body 120 currently faces can be obtained by updating the azimuth direction calculated by the position and azimuth direction calculator 125 based on the swing speed of the swing body 120 output by the inclination measuring device 126.

The adjustment determination unit 1109 determines whether or not the swing angle difference when the swing body 120 stops is within an allowable range RE based on the swing angle difference and the swing speed during braking of the swing motor 703. The absolute values of an upper limit value REsup and a lower limit value REinf of the allowable range RE are examples of the allowable angle. Specifically, the adjustment determination unit 1109 determines that the swing angle difference when the swing body 120 stops exceeds the allowable range RE in a case where the swing speed is lower than a predetermined speed threshold value Sth and the swing angle difference exceeds an allowable angle difference range RD determined from the swing speed. In a case where the swing angle difference is within the allowable angle difference range RD, the adjustment determination unit 1109 determines that the swing angle difference when the swing body 120 stops does not exceed the allowable range RE.

Figure 5:
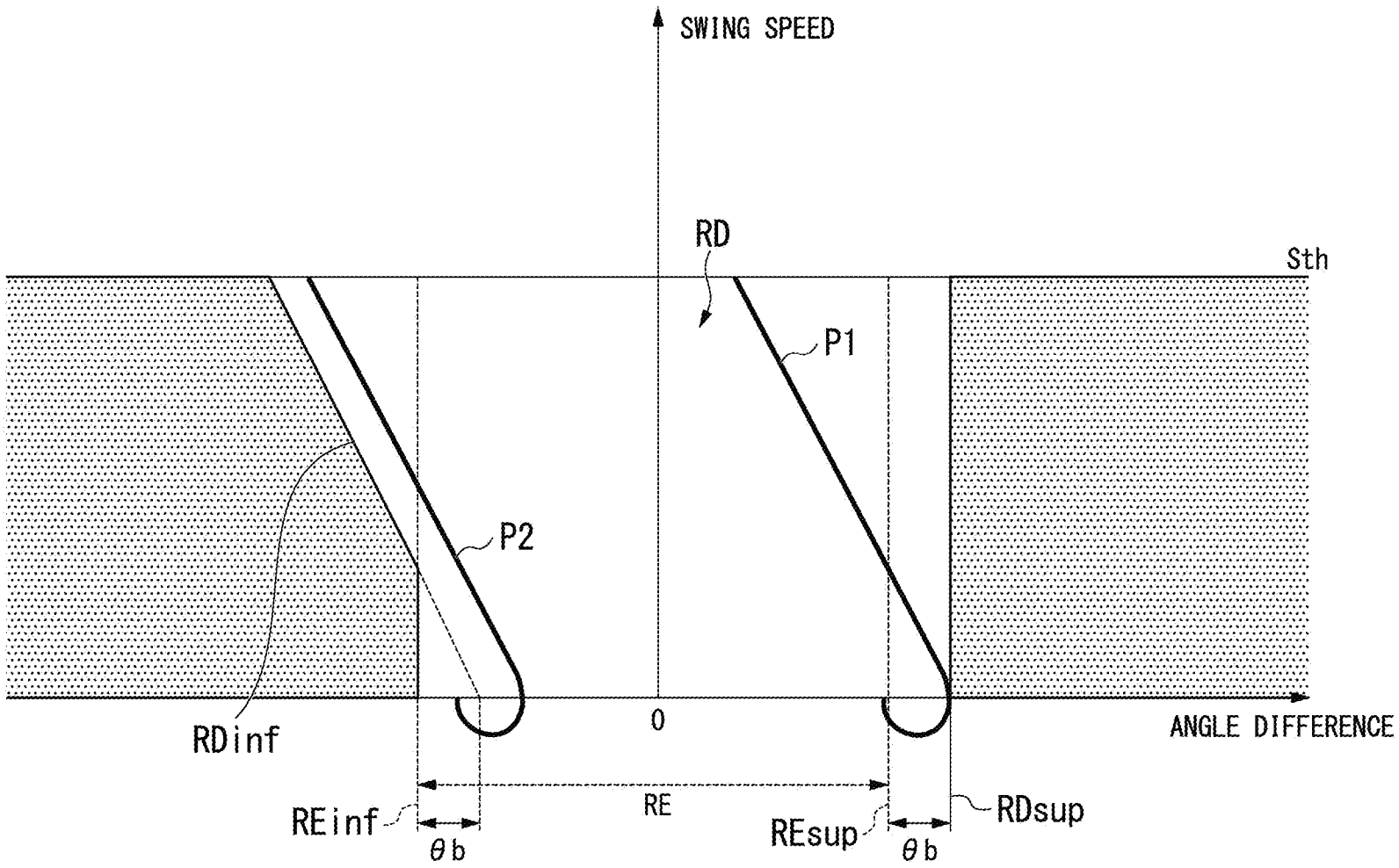
FIG. 5 is a view showing a relationship between a swing speed and an allowable angle difference range.

FIG. 5 is a view showing a relationship between the swing speed and the allowable angle difference range. The relationship between the swing speed and the allowable angle difference range RD is stored in a main memory or the like in advance.

An upper limit value RDsup of the allowable angle difference range RD is a value greater than the upper limit value REsup of the allowable range RE by an angle corresponding to a swing-back angle θb of the swing body 120. The swing-back is a phenomenon in which a swinging in the opposite direction occurs after the swinging stops due to a reaction caused by factors such as inertia of the swing body 120, backlash of mechanical elements, and compressibility of hydraulic oil. In other words, as shown in a swing pattern P1 of FIG. 5, even when the swing angle difference of the swing body 120 becomes greater than the upper limit value REsup of the allowable range RE at a certain point during the braking, in a case where the swing angle difference is within the allowable angle difference range RD, the swing angle difference of the swing body 120 when the swing body 120 stops is within the allowable range RE due to the swing-back after the stop. The absolute value of the upper limit value RDsup of the allowable angle difference range RD is an example of a front side angle threshold value.

A lower limit value RDinf of the allowable angle difference range RD is determined by the swing speed of the swing body 120. Specifically, a value that is greater than the lower limit value REinf of the allowable range RE by an angle corresponding to the swing-back angle θb of the swing body 120 is used as an intercept of a swing angle difference axis, and of the angle determined by a braking function having the same inclination as the inclination of the change in swing angle difference with respect to the swing speed of the swing body 120 and the lower limit value REinf of the allowable range RE, the smaller one is set as the lower limit value RDinf of the allowable angle difference range RD. In other words, as shown in a swing pattern P2 of FIG. 5, even when the swing angle difference of the swing body 120 becomes smaller than the lower limit value REinf of the allowable range RE at a certain point during the braking, in a case where the swing angle difference is within the allowable angle difference range RD, the swing angle difference of the swing body 120 when the swing body 120 stops is within the allowable range RE due to the rotation of the swing body 120. The absolute value of the lower limit value RDinf of the allowable angle difference range RD is an example of a rear side angle threshold value.

Figure 6:
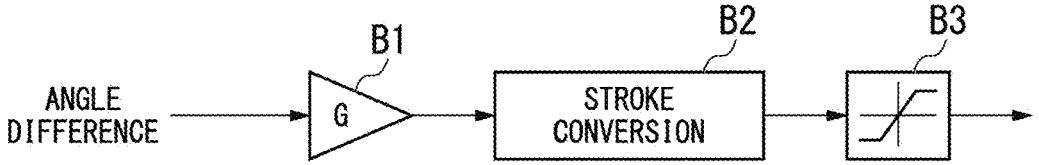
FIG. 6 is a schematic block diagram showing an operation of a controlled variable determination unit.

The controlled variable determination unit 1110 generates an operation signal indicating a stroke amount (controlled variable) of a spool of the direction control valve 704 based on the swing angle difference of the swing body 120. FIG. 6 is a schematic block diagram showing the operation of the controlled variable determination unit. Specifically, the controlled variable determination unit 1110 determines the opening area between the hydraulic pump 702 of the direction control valve 704 and the swing motor 703 by multiplying the swing angle difference of the swing body 120 with a predetermined gain (B1). Next, the controlled variable determination unit 1110 converts the opening area into the stroke amount of the spool of the direction control valve 704 (B2). Next, the controlled variable determination unit 1110 limits the converted stroke amount to a value between the maximum value and the minimum value of the stroke-movable range of the spool (B3).

The operation signal output unit 1111 outputs the operation signal input to the operation signal input unit 1103, the operation signal generated by the movement processing unit 1107, or the operation signal generated by the controlled variable determination unit 1110. Specifically, the operation signal output unit 1111 outputs the operation signal generated by the movement processing unit 1107 in a case where the automatic loading control is being performed and the swing body 120 is accelerating. Further, when the automatic loading control is being performed and the swing body 120 is decelerating, in a case where the adjustment determination unit 1109 determines that the swing angle difference exceeds the allowable range RE when the swing body 120 stops, the operation signal output unit 1111 outputs the operation signal generated by the controlled variable determination unit 1110. Further, when the automatic loading control is being performed and the swing body 120 is decelerating, in a case where the adjustment determination unit 1109 does not determine that the swing angle difference exceeds the allowable range RE when the swing body 120 stops, the operation signal output unit 1111 outputs the operation signal generated by the movement processing unit 1107. Further, the operation signal output unit 1111 outputs the operation signal generated by the operation signal input unit 1103 in a case where the automatic loading control is not being performed.

<<Operation>>

When the operator of the loading machine 100 determines that the loading machine 100 and the loading target 200 are in a positional relationship that allows loading processing, the operator switches on the operating device 123. Accordingly, the operating device 123 generates and outputs a loading command signal.

Figure 7:
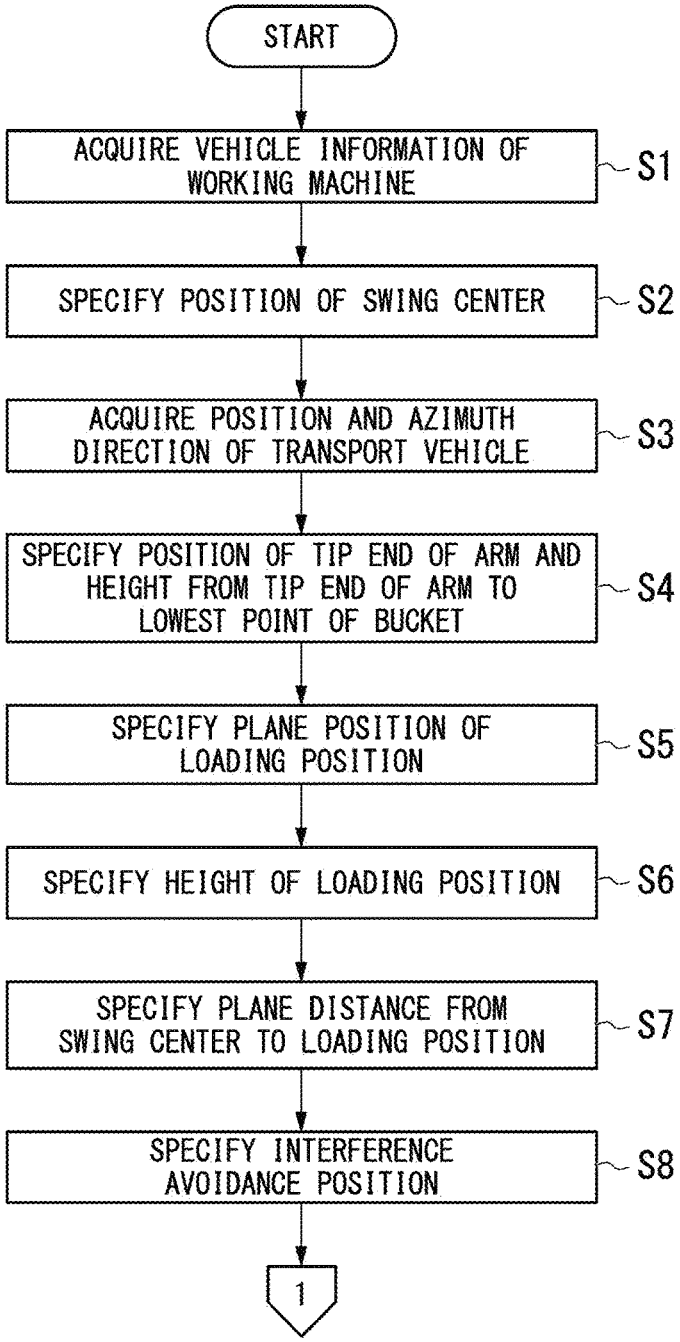
FIG. 7 is a flowchart showing an automatic loading control method according to the first embodiment.
Figure 8:
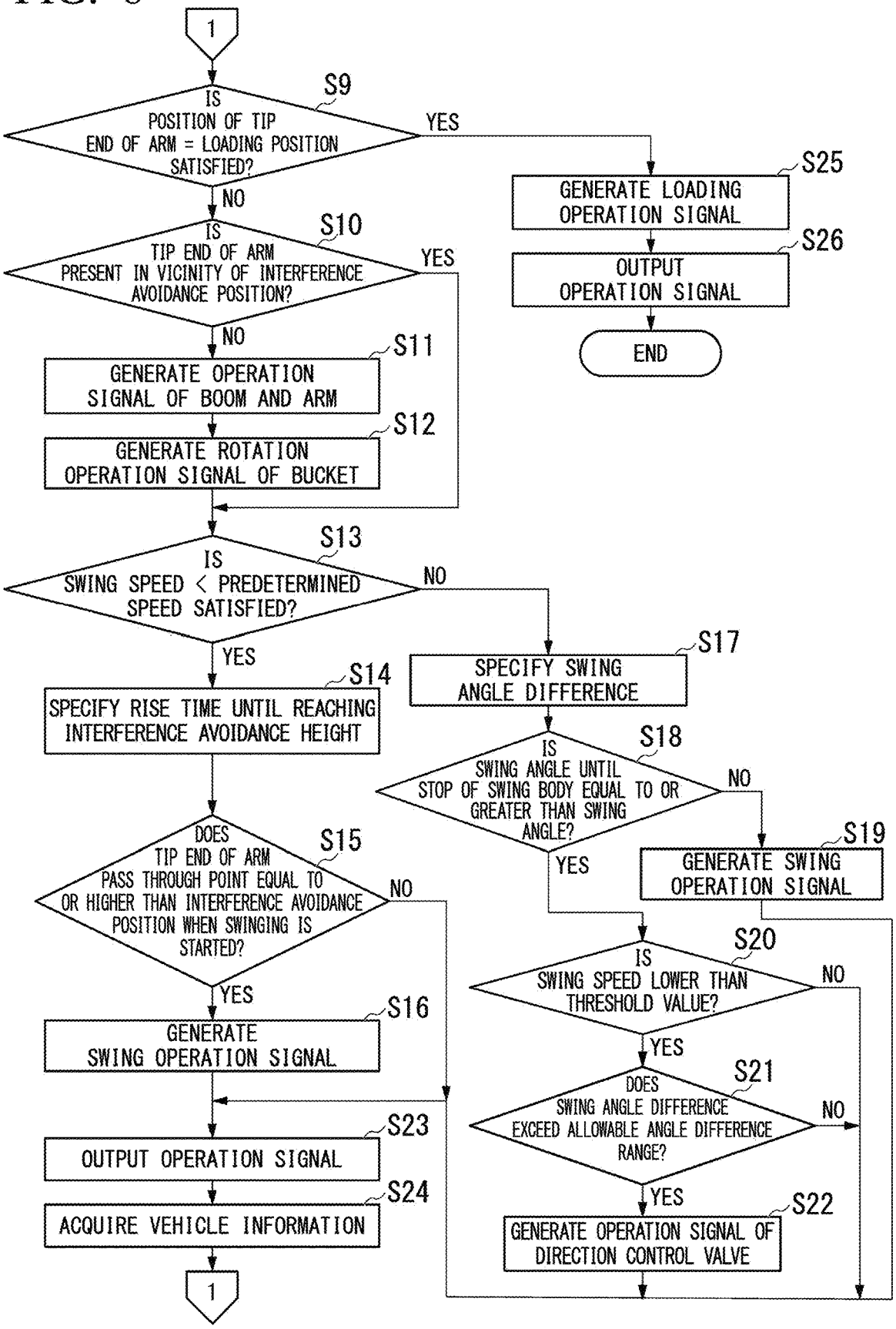
FIG. 8 is a flowchart showing the automatic loading control method according to the first embodiment.

FIGS. 7 and 8 are flowcharts showing an automatic loading control method according to the first embodiment. When the control device 128 receives the input of the loading command signal from the operator, the control device 128 executes the automatic loading control shown in FIGS. 7 and 8.

a. The vehicle information acquisition unit 1101 acquires the position and the azimuth direction of the swing body 120, the inclination angles of the boom 131, the arm 132, and the bucket 133, the posture of the swing body 120 (step S1). The vehicle information acquisition unit 1101 specifies the position of the swing center of the swing body 120 based on the acquired position and the azimuth direction of the swing body 120 (step S2). Then, the detection information acquisition unit 1102 acquires the three-dimensional position information of the loading target 200 from the detecting device 124 and specifies the position and the shape of the loading target 200 from the three-dimensional position information (step S3).

Based on the vehicle information acquired by the vehicle information acquisition unit 1101, the bucket position specification unit 1104 specifies the position P of the tip end of the arm 132 when the loading command signal is input, and the height from the tip end of the arm 132 to the lowest point of the bucket 133 (step S4). The bucket position specification unit 1104 specifies the position P as the excavation completion position P10.

The loading position specification unit 1105 converts the position information of the loading target 200 acquired by the detection information acquisition unit 1102 from the site coordinate system to the shovel coordinate system based on the position, the azimuth direction, and the posture of the swing body 120 acquired in step S1. The loading position specification unit 1105 specifies the plane position of the loading position P13 based on the position and the shape of the loading target 200 specified by the detection information acquisition unit 1102 (step S5). At this time, the loading position specification unit 1105 specifies the height of the loading position P13 by adding the height Hb from the tip end of the arm 132 specified in step S4 to the lowest point of the bucket 133 and the height for the control margin of the bucket 133, to the height Ht of the loading target 200 (step S6).

The avoidance position specification unit 1106 specifies the plane distance from the swing center to the loading position P13 (step S7). The avoidance position specification unit 1106 specifies the position separated from the swing center by the specified plane distance, that is, the position at which the outer shape of the bucket 133 does not interfere with the loading target 200 in a plan view and which is the closest to the loading position P13, as the interference avoidance position P12 (step S8).

The movement processing unit 1107 determines whether or not the position of the tip end of the arm 132 has reached the loading position P13 (step S9). In a case where the position of the tip end of the arm 132 has not reached the loading position P13 (step S9: NO), the movement processing unit 1107 determines whether or not the position of the tip end of the arm 132 is in the vicinity of the interference avoidance position P12. For example, the movement processing unit 1107 determines whether or not a difference between a height of the tip end of the arm 132 and a height of the interference avoidance position P12 is less than a predetermined threshold value, or a difference between the plane distance from the swing center of the swing body 120 to the tip end of the arm 132 and the plane distance from the swing center to the interference avoidance position P12 is less than a predetermined threshold value (step S10). In a case where the position of the tip end of the arm 132 is not in the vicinity of the interference avoidance position P12 (step S10: NO), the movement processing unit 1107 generates the operation signal of the boom 131 and the arm 132 that moves the tip end of the arm 132 to the interference avoidance position P12 (step S11). At this time, the movement processing unit 1107 generates the operation signal based on the positions and speeds of the boom 131 and the arm 132.

In addition, the movement processing unit 1107 calculates a sum of the angular velocities of the boom 131 and the arm 132 based on the generated operation signals of the boom 131 and the arm 132, and generates the operation signal for rotating the bucket 133 at the same speed as the sum of the angular velocities (step S12). Accordingly, the movement processing unit 1107 can generate the operation signal for holding the ground angle of the bucket 133. In another embodiment, the movement processing unit 1107 may generate the operation signal for rotating the bucket 133 such that the ground angle of the bucket 133 obtained by calculating from the detected values of the boom angle sensor 137, the arm angle sensor 138, and the bucket angle sensor 139 becomes equal to the ground angle when automatic control is started.

In a case where the position of the tip end of the arm 132 is in the vicinity of the interference avoidance position P12 (step S10: YES), the movement processing unit 1107 does not generate the operation signals of the boom 131, the arm 132, and the bucket 133.

The movement processing unit 1107 determines whether or not the swing speed of the swing body 120 is lower than a predetermined speed based on the vehicle information acquired by the vehicle information acquisition unit 1101 (step S13). In other words, the movement processing unit 1107 determines whether or not the swing body 120 is swinging.

In a case where the swing speed of the swing body 120 is lower than the predetermined speed (step S13: YES), the movement processing unit 1107 specifies a rise time which is time for the height of the bucket 133 to reach the height of the interference avoidance position P12 from the height of the excavation completion position P10 (step S14). In a case where the swing operation signal is output at the current time based on the rise time of the bucket 133, the movement processing unit 1107 determines whether or not the tip end of the arm 132 passes through the interference avoidance position P12 or a point higher than the interference avoidance position P12 (step S15). In a case where the swing operation signal is output at the current time, and in a case where the tip end of the arm 132 passes through the interference avoidance position P12 or the point higher than the interference avoidance position P12 (step S15: YES), the movement processing unit 1107 generates the swing operation signal for controlling the opening of the direction control valve 704 to the maximum opening (step S16).

In a case where the swing operation signal is output at the current time, and in a case where the tip end of the arm 132 passes through a point lower than the interference avoidance position P12 (step S15: NO), the movement processing unit 1107 does not generate the swing operation signal.

In a case where the swing speed of the swing body 120 is equal to or higher than the predetermined speed (step S13: NO), the angle difference specification unit 1108 specifies the swing angle difference that is the angle formed by the azimuth direction in which the swing body 120 currently faces and the target stop azimuth direction (step S17).

In a case where the output of the swing operation signal is stopped from the current time, the movement processing unit 1107 determines whether or not the swing angle of the swing body 120 until the stop is equal to or greater than the swing angle difference (step S18). After the output of the swing operation signal is stopped, the swing body 120 continues to swing due to inertia while decelerating, and then stops. In a case where the output of the swing operation signal is stopped from the current time, and in a case where it is not determined that the swing angle of the swing body 120 until the stop is equal to or greater than the swing angle difference, that is, in a case where it is not determined that the tip end of the arm 132 reaches the loading position P13 (step S18: NO), the movement processing unit 1107 generates a swing operation signal (step S19). Accordingly, the swing body 120 continues swinging.

In a case where it is determined that the swing angle of the swing body 120 until the stop is equal to or greater than the swing angle difference (step S18: YES), the adjustment determination unit 1109 determines whether or not the swing speed is lower than a predetermined speed threshold value Sth (step S20). In a case where the swing speed is equal to or higher than the speed threshold value Sth (step S20: NO), the adjustment determination unit 1109 does not cause the control device 128 to generate the operation signal for swinging the swing body 120. Accordingly, the swing body 120 decelerates.

In a case where the swing speed is lower than the speed threshold value Sth (step S20: YES), the adjustment determination unit 1109 determines whether or not the swing angle difference exceeds the allowable angle difference range RD (step S21). In a case where the swing angle difference does not exceed the allowable angle difference range RD (step S21: NO), the adjustment determination unit 1109 determines that the swing angle difference is within the allowable range RE when the swing body 120 stops, and the control device 128 does not generate an operation signal for rotating the swing body 120.

On the other hand, in a case where the swing angle difference exceeds the allowable angle difference range RD (step S21: YES), the adjustment determination unit 1109 determines that the swing angle difference exceeds the allowable range RE when the swing body 120 stops. When the adjustment determination unit 1109 determines that the swing angle difference exceeds the allowable range RE when the swing body 120 stops, the controlled variable determination unit 1110 determines the stroke amount based on the swing angle difference as shown in FIG. 6, and generates the control signal of the direction control valve 704 (step S22).

When at least one of the operation signals of the boom 131, the arm 132, and the bucket 133 and the operation signal of the direction control valve 704 is generated by the processing from step S9 to step S22, the operation signal output unit 1111 outputs the generated operation signal to the hydraulic device 127 (step S23).

Then, the vehicle information acquisition unit 1101 acquires the vehicle information (step S24). Accordingly, the vehicle information acquisition unit 1101 can acquire the vehicle information after operating by the output operation signal. The control device 128 returns the process to step S9, and repeatedly executes the generation of the operation signal.

On the other hand, in a case where the position of the tip end of the arm 132 has reached the loading position P13 in step S9 (step S9: YES), the movement processing unit 1107 generates the operation signal that causes the bucket 133 to perform a loading operation (step S25). Examples of the operation signal for causing the bucket 133 to perform the loading operation include an operation signal for rotating the bucket 133 in a soil removal direction and an operation signal for opening the clam shell in a case where the bucket 133 is a clam bucket. The operation signal output unit 1111 outputs the generated operation signal to the hydraulic device 127 (step S26). Then, the control device 128 ends the automatic loading control.

<<Operation Example>>

Figure 9:
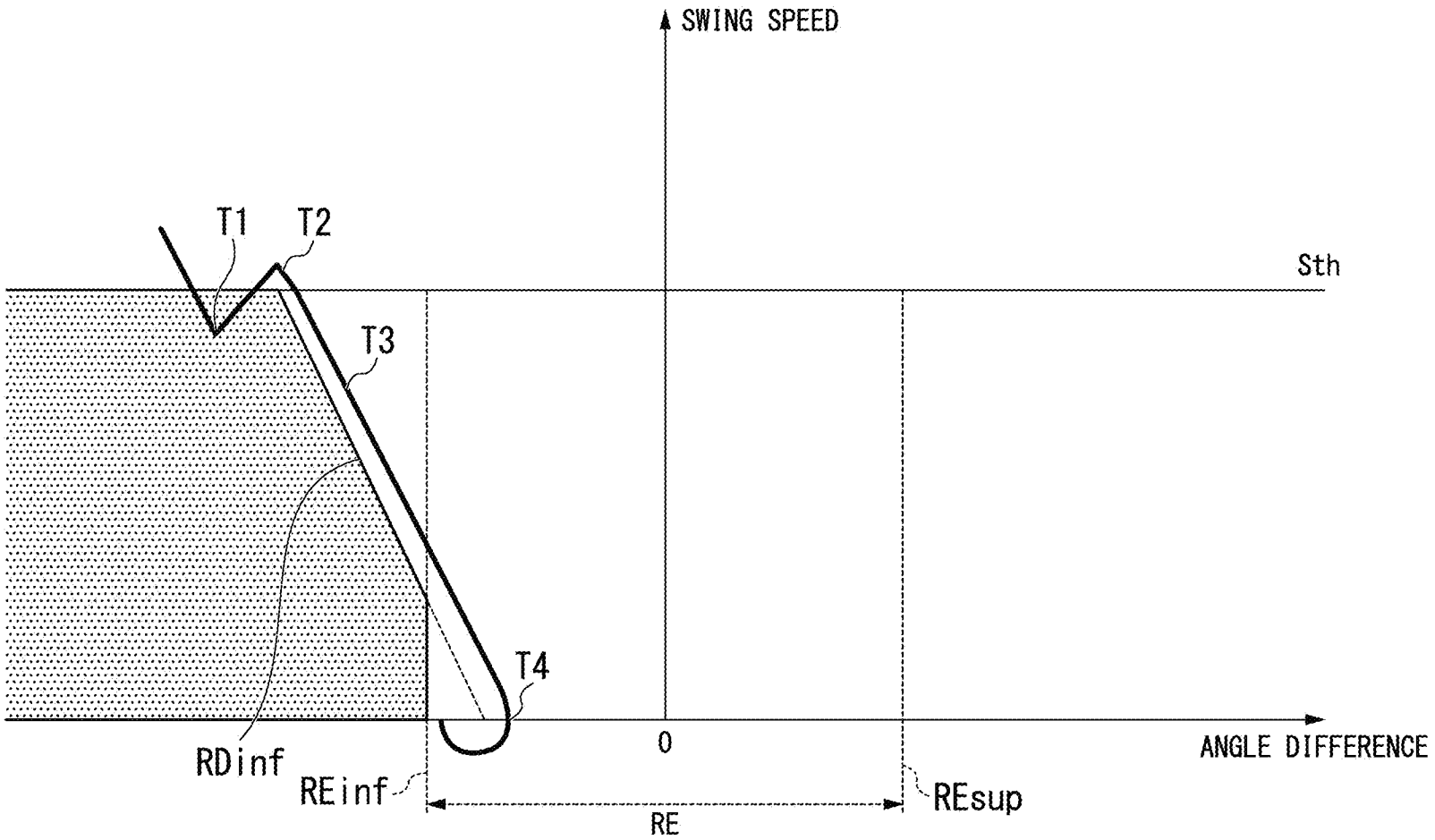
FIG. 9 is a view showing a first example of a swing control operation by the control device according to the first embodiment.

Here, the swing control operation by the control device 128 according to the first embodiment will be described with reference to FIG. 9. FIG. 9 is a view showing a first example of the swing control operation by the control device according to the first embodiment.

When the swinging of the swing body 120 is braked by the automatic loading control and the swing speed becomes lower than the speed threshold value Sth at time T1, the adjustment determination unit 1109 of the control device 128 determines whether or not the swing angle difference exceeds the allowable angle difference range RD. At time T1, since the swing angle difference exceeds the allowable angle difference range RD in the negative direction (the swing angle difference is less than the lower limit value RDinf of the allowable angle difference range RD), the controlled variable determination unit 1110 generates a control signal of the stroke amount in accordance with the swing angle difference. Accordingly, the swing body 120 accelerates the swing speed. After that, when the swing speed becomes equal to or higher than the speed threshold value Sth at time T2, the control device 128 does not generate the control signal. Accordingly, the swinging of the swing body 120 is braked again.

After this, when the swing speed becomes lower than the speed threshold value Sth at time T3, the adjustment determination unit 1109 of the control device 128 determines whether or not the swing angle difference exceeds the allowable angle difference range RD. Since the swing angle difference does not exceed the allowable angle difference range at time T3, the control device 128 does not generate the control signal. After this, since the swing angle difference does not exceed the allowable angle difference range until the swing body 120 stops, the control device 128 does not generate the control signal. After this, when the swing speed becomes zero at time T4, the swing body 120 swings in the opposite direction by swing-back. Since the lower limit value RDinf of the allowable angle difference range RD is determined based on a braking function in which a value greater than the lower limit value REinf of the allowable range RE by an angle corresponding to the swing-back angle θb of the swing body 120 is set as an intercept, the swing angle difference after swing-back is within the allowable range RE.

In this manner, the control device 128 can suppress the frequency of outputting the swing control signal during braking of the swing body 120, and can keep the swing angle difference within the allowable range RE.

Figure 10:
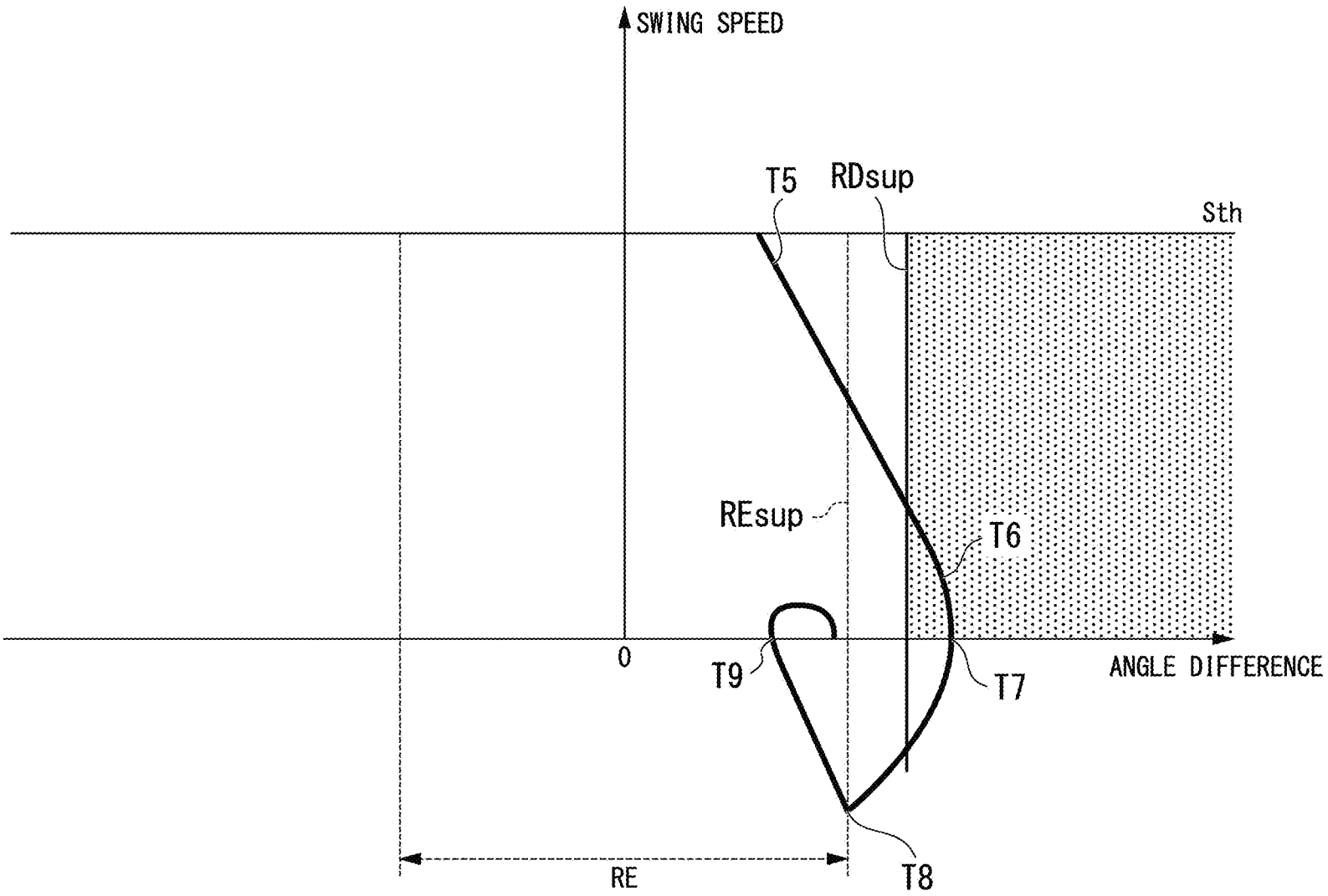
FIG. 10 is a view showing a second example of the swing control operation by the control device according to the first embodiment.

Here, the swing control operation by the control device 128 at the overshoot according to the first embodiment will be described with reference to FIG. 10. FIG. 10 is a view showing a second example of the swing control operation by the control device according to the first embodiment.

When the swinging of the swing body 120 is braked by the automatic loading control and the swing speed becomes lower than the speed threshold value Sth at time T5, the adjustment determination unit 1109 of the control device 128 determines whether or not the swing angle difference exceeds the allowable angle difference range RD. Since the swing angle difference does not exceed the allowable angle difference range at time T5, the control device 128 does not generate the control signal. After this, at time T6, the swing angle difference exceeds the allowable angle difference range RD in the positive direction (the swing angle difference exceeds the upper limit value RDsup of the allowable angle difference range RD). Therefore, the controlled variable determination unit 1110 generates a control signal for rotating the swing motor 703 in the direction opposite to the swing direction, that is, in the negative direction. However, since the swing motor 703 operates with the braking force equivalent to the relief pressure of the second relief valve 710, the deceleration of the swing speed does not increase.

After this, when the swing speed becomes zero at time T7, the swing motor 703 starts rotation in the direction opposite to the previous swing direction by the control signal generated by the controlled variable determination unit 1110. In other words, in a case where the swing angle difference exceeds the upper limit value RDsup of the allowable angle difference range RD, the control signal for rotating the swing motor 703 in the negative direction is generated in advance. Therefore, when the swing speed of the swing body 120 becomes zero, it is possible to swing the swing body 120 in the negative direction immediately.

After time T7, the control device 128 outputs the swing control signal until the swing angle difference is within the allowable range RE at time T8.

After the time T8, when the swing angle difference is within the allowable range RE, the control device 128 does not generate the control signal. After this, the swing body 120 decelerates by inertia, and when the swing speed becomes zero at time T9, the swing body 120 swings in the direction opposite to the negative direction, that is, in the positive direction again, due to the swing-back. Since the swing angle at which the swing body 120 swings in the positive direction by the swing-back after T9 is considered to be smaller than the swing angle at which the swing body 120 rotates by inertia after T8, the swing angle difference after swing-back is within the allowable range RE.

In this manner, even in a case where the swinging of the swing body 120 overshoots, the control device 128 can immediately swing the swing body 120 in the opposite direction, and keep the swing angle difference within the allowable range RE.

<<Action and Effect>>

In this manner, the control device 128 according to the first embodiment determines whether or not the swing angle difference when the swing body 120 stops is within the allowable range RE, based on the azimuth direction, the swing speed, and the target stop azimuth direction of the swing body 120 during braking of the swing motor 703. Then, in a case where it is determined that the swing angle difference when the swing body 120 stops exceeds the allowable range RE, the control device 128 outputs a swing control signal for causing the swing motor 703 to supply hydraulic oil to the hydraulic device 127. Accordingly, the control device 128 can reduce the frequency of outputting the swing control signal during braking of the swing body 120. In other words, the control device 128 can control the azimuth direction of the swing body 120 by performing swing control as necessary.

Further, in a case where the swing speed of the swing body 120 is lower than the predetermined threshold value, the control device 128 according to the first embodiment determines whether or not the swing angle difference when the swing body 120 stops is within the allowable range RE. In other words, the control device 128 does not perform the swing control when there is a possibility that the speed of the swing body 120 is high and the influence of the swing control by the controlled variable determination unit 1110 becomes excessive. Accordingly, the control device 128 can reduce the frequency of outputting the swing control signal during braking of the swing body 120 and reduce the possibility that the swing body 120 overshoots. Further, regardless of the swing speed of the swing body 120, the control device 128 according to another embodiment may determine whether or not the swing angle difference when the swing body 120 stops is within the allowable range RE.

Further, in a case where the swing angle difference is smaller than the lower limit value RDinf of the allowable angle difference range RD, the control device 128 according to the first embodiment outputs the swing control signal for supplying the hydraulic oil so as to rotate the swing motor 703 in the current rotational direction with an oil amount in accordance with the swing angle difference of the swing body 120. In other words, in a case where the azimuth direction of the swing body 120 is on the rear side of the target stop azimuth direction in the swing direction, and in a case where the absolute value of the swing angle difference is greater than the absolute value of the lower limit value RD of the allowable angle difference range RD, the control device 128 outputs the swing control signal for rotating the swing motor 703 in the current rotational direction. Accordingly, the control device 128 can suppress the frequency of outputting the swing control signal during braking of the swing body 120, and can keep the swing angle difference within the allowable range RE.

Further, the lower limit value RDinf of the allowable angle difference range RD according to the first embodiment is equal to or less than the lower limit value REinf of the allowable range RE, and becomes smaller as the swing speed increases. In other words, the absolute value of the lower limit value RDinf of the allowable angle difference range RD is equal to or greater than the absolute value of the lower limit value REinf of the allowable range RE and becomes greater as the swing speed increases. Accordingly, the control device 128 can control the swing such that the swing angle difference of the swing body 120 after swing-back is within the allowable range RE.

Further, in a case where the azimuth direction of the swing body 120 is on the front side of the target stop azimuth direction in the swing direction, and in a case where the angle formed by the azimuth direction of the swing body 120 and the target stop azimuth direction is greater than the upper limit value RDsup of the allowable angle difference range RD, the control device 128 according to the first embodiment outputs the swing control signal for supplying the hydraulic oil so as to rotate the swing motor 703 in the direction opposite to the current rotational direction with an oil amount in accordance with the swing angle difference of the swing body 120. Accordingly, the control device 128 can suppress the frequency of outputting the swing control signal during braking of the swing body 120 and can immediately swing the swing body 120 in the opposite direction in a case where the swinging of the swing body 120 overshoots.

Further, the upper limit value RDsup of the allowable angle difference range RD according to the first embodiment is a value obtained by adding the upper limit value REsup of the allowable range RE and the swing-back angle θb of the swing body 120. Accordingly, even when the swing angle difference of the swing body 120 becomes greater than the upper limit value REsup of the allowable range RE at a certain point during the braking, in a case where the swing angle difference is within the allowable angle difference range RD, the swing angle difference of the swing body 120 when the swing body 120 stops is within the allowable range RE due to the swing-back after the stop.

Above, the embodiment has been described in detail with reference to the drawings, but the specific configuration is not limited to the above-described configuration, and various design changes can be made.

For example, the control device 128 according to the above-described embodiment outputs the swing control signal that reverses the rotational direction of the swing motor 703 in a case where the swing body 120 overshoots, but the invention is not limited thereto. For example, in a case where the second relief valve 710 according to another embodiment can adjust the relief pressure, when the swing angle difference of the swing body 120 exceeds the upper limit value RDsup of the allowable angle difference range RD, a control signal that increases the relief pressure may be output in addition to the output of the swing control signal for reversing the rotational direction of the swing motor 703. At this time, the threshold value of the swing angle difference of the swing body 120 for outputting the signal for increasing the relief pressure may be smaller than the upper limit value RDsup of the allowable angle difference range RD.

The swing motor according to the above-described embodiment is a hydraulic swing motor driven by hydraulic oil supplied from a hydraulic device, but is not limited thereto. For example, the swing motor according to another embodiment may be an electric motor driven by electric power supplied from a power storage device or an external power source. Further, the swing motor according to another embodiment may be a swing motor in which an electric motor and a hydraulic motor are connected.

The control device according to the present invention can control the azimuth direction of the swing body by performing swing control as necessary.

The invention claimed is:

1. A control device of a loading machine including a swing motor and a swing body, the swing motor being a hydraulic swing motor that is rotated by hydraulic oil and the swing body being configured to swing around a swing center by rotation of the swing motor, the control device comprising:

an adjustment determination unit that, during braking of the swing motor, determines whether or not an angle formed by an azimuth direction of the swing body and a target stop azimuth direction will be less than an allowable angle when the swing body stops, the allowable angle being based on the azimuth direction, a swing speed, and the target stop azimuth direction of the swing body; and an operation signal output unit that outputs a swing control signal to drive the swing motor in a case where the adjustment determination unit has determined that the stop angle will be equal to or greater than the allowable angle when the swing body stops, the operation signal output unit being configured such that, during braking, in a case in which the adjustment determination unit determines that the azimuth direction of the swing body is on a front side of the target stop azimuth direction in a swing direction and the angle is greater than a front side angle threshold value, the operation signal output unit outputs the swing control signal to supply the hydraulic oil so as to rotate the swing motor in a direction opposite to a current rotational direction using an oil amount determined in accordance with the angle.

2. The control device according to claim 1, wherein the adjustment determination unit is configured to determine whether or not the angle is greater than the front side angle threshold value when the swing speed is determined to be lower than a predetermined threshold value.

3. The control device according to claim 1, wherein the operation signal output unit is configured such that, during braking, in a case in which the azimuth direction of the swing body is on a rear side of the target stop azimuth direction in the swing direction and the angle is greater than a rear side angle threshold value determined based on the swing speed, the operation signal output unit outputs the swing control signal to supply the hydraulic oil so as to rotate the swing motor in a current rotational direction with an oil amount in accordance with the angle.

4. The control device according to claim 3, wherein the rear side angle threshold value is equal to or greater than the allowable angle and increases as the swing speed increases.

5. The control device according to claim 1, wherein the front side angle threshold value is obtained by adding the allowable angle and a swing-back angle of the swing body.

6. A control method of a loading machine including a swing motor and a swing body, the swing motor being a hydraulic swing motor that is rotated by hydraulic oil and the swing body being configured to swing around a swing center by rotation of the swing motor, the control method comprising:

determining, during braking of the swing motor, whether or not an angle formed by an azimuth direction of the swing body and a target stop azimuth direction will be less than an allowable angle when the swing body stops, the allowable angle being based on the azimuth direction, a swing speed, and the target stop azimuth direction of the swing body; and outputting a swing control signal for driving the swing motor in a case in which the result of the determining is that the angle will be equal to greater than the allowable angle when the swing body stops, the determining including determining whether the azimuth direction is on a front side of the target stop azimuth direction in a swing direction and the angle is greater than a front side angle threshold value, the outputting the swing control signal including outputting the swing control signal to supply the hydraulic oil so as to rotate the swing motor in a direction opposite to a current rotational direction using an oil amount determined in accordance with the angle when a result of the determining is that the azimuth direction is on the front side of the target stop azimuth direction in the swing direction and the angle is greater than the front side angle threshold value.

* * * * *